United States Patent [19]

Jorgensen et al.

[11] 4,449,641

[45] May 22, 1984

[54] CONTAINER OF PLASTIC MATERIAL WITH A LID

[75] Inventors: Knud E. Jorgensen, Haarby; Ole Ingemann, Tasinge, both of Denmark

[73] Assignee: D.M.E. Plastic A/S, Haarby, Denmark

[21] Appl. No.: 385,119

[22] Filed: Jun. 4, 1982

[30] Foreign Application Priority Data

Jun. 11, 1981 [DK] Denmark ..... 2561/81

[51] Int. Cl.[3] ..... B65D 41/16; B65D 41/18

[52] U.S. Cl. ..... 220/306; 220/307; 220/270

[58] Field of Search ..... 220/306, 307, 354, 270; 150/0.5

[56] References Cited

U.S. PATENT DOCUMENTS 4,296,871 10/1981 Anderson ..... 220/354

FOREIGN PATENT DOCUMENTS 1582416 1/1981 United Kingdom ..... 220/354

*Primary Examiner*—George T. Hall

*Attorney, Agent, or Firm*—Watson, Cole, Grindle & Watson

[57] ABSTRACT

A plastics container with a lid having a skirt extending downwardly around the upper edge portion of the container, the lower edge of the skirt being covered by a protecting member connected with the outer side of the container wall, the protecting member having a vertical flange provided at its upper edge with an inner bead which in the closed position of the lid engages with an outer bead on the skirt at the lower edge thereof.

Such arrangement improves upon resistance against disengagement of the lid from the container in the case of elevated pressure in the container or strong deformation of the container.

8 Claims, 4 Drawing Figures

CONTAINER OF PLASTIC MATERIAL WITH A LID

BACKGROUND OF THE INVENTION

This invention relates to a container of plastics material with a lid having a skirt extending downwardly around the upper edge portion of the container wall, the lower edge portion of the skirt being covered by a protecting member connected with the outer side of the container and having a flange located outside the skirt of the lid and substantially parallel thereto.

Such containers are known from the U.K patent specification No. 1,489,515. These known plastics containers distinguish themselves by providing an efficient safety against unintentional disengagement of the lid from the container by forces tending to press the skirt of the lid outwardly and upwardly, such as may e.g. occur if two filled containers, not having a protecting member as described, happen to be placed in such a manner that the lower edge of the skirt of the lid of one container rests on the upper edge of the lid of the other container.

However, these known containers have the drawback that they do not provide a similar safety against unintentional opening in the event of pressure created within the container. In such case the central portion of the lid will be domed upwardly whereby the lid may be disengaged from the upper edge portion of the container. This drawback is especially manifest in the case of containers having a relatively large volume, such as 1 l. or more.

A similar problem may occur when the sides of relatively large containers are pressed against one another.

SUMMARY OF THE INVENTION

It is the object of the invention to provide a plastics container of the kind described offering improved safety against disengagement of the lid as a consequence of the occurrence of an elevated pressure in the interior of the container, or as a consequence of strong deformation of the container.

With this object in view, according to the invention, a plastics container of the kind described is characterized in that the flange of the protecting member is provided at its upper edge with an inwardly extending bead, and the skirt of the lid is provided at its lower edge with an outwardly extending bead which in the closed position of the lid is located below the inner bead of the flange of the protecting member and is in contact with that flange.

If, in a closed container according to the invention, an inner pressure arises and reaches a size such that the lid tends to move upwardly, such movement will be counteracted by the outer bead of the skirt of the lid abutting the inner bead of the flange of the protecting member. The lid will therefore remain in position on the container except in the event of extremely high inner pressures. A similar effect is obtained in the event of strong deformation of the container by opposite sides being pressed against one another.

To obtain further improved safety against unintentional disengagement of the lid and to eliminate the risk of the skirt of the lid with its outer bead being displaced towards the container wall and thereby being moved past the inner bead of the flange of the protecting member, the flange may advantageously be connected with the outer side of the container wall by means of an inclined wall sloping downwardly from the container wall towards the lower edge of the flange and being so shaped that the inner side of the skirt of the lid is in contact with the inclined wall in the closed position of the lid.

A particularly efficient safety against displacement of the lower edge of the skirt of the lid towards the container wall is obtained by an embodiment, in which the outer side of the inclined wall is constructed with a projecting portion having a vertical surface which is so arranged that the vertical surface is in contact with a corresponding vertical surface on the inner side of the skirt of the lid, preferably at the lower edge of the skirt.

When the flange of the protecting member is connected with the outer side of the container wall by means of an inclined wall, it is possible that, under extreme forces acting on the lid, the upper portion of the flange of the protecting member might be pressed outwardly so as to enable the outer bead of the skirt of the lid to move past the inner bead of the flange, and to avoid this the protecting member may be reinforced by means of ribs connecting the outer side of the container wall with the inner side of said inclined wall. Such ribs may be provided at short intervals along the periphery of the container mouth. As an example they may be provided at an angular spacing of 8°.

The lid of the container is preferably of the kind having a depressed central portion which is limited by a circular vertical wall, the outer side of which is in contact with the inner side of the container wall at the upper edge portion thereof.

If a high inner pressure builds up in a container having such a lid, considerable forces may be created which will tend to create an increase of the outer diameter of the lid. This will result in a very strong pressure on the upper portion of the flange of the protecting member, and may have the effect that the outer bead on the lower portion of the skirt of the lid may move past the inner bead on the bent-up flange of the protecting member. To counteract this, the upper edge of the skirt of the lid is connected with the portion of the lid located above the upper edge of the container wall by means of a flexible, upwardly and outwardly inclined wall.

With this construction of the lid the above-mentioned forces may in part be taken up by the such portion of the lid, whereby less forces will be transferred from the skirt of the lid to the flange of the protecting member.

To improve the stackability of the lids for containers according to the invention, an annular flange is preferably provided on the underside of the lid in the area between the outer side of the container wall and the skirt of the lid.

The upper edge portion of the container may be constructed on its outer side with an inclined guiding surface serving to guide the lid into position when the lid is placed on and applied to the container by automatic means.

To allow for opening the container according to the invention, one should have access, or the possibility of establishing access, to the lower edge of the skirt of the lid, so that this can be pressed upwardly and outwardly so as to be disengaged from the flange of the protecting member. This may be obtained by omitting the protecting member over a sufficient length of the periphery of the container mouth to permit gripping of the lower edge of the skirt of the lid to initiate disengagement of the lid from the container. To protect the length of the skirt of the lid which is exposed by omitting the protecting member against shocks from below, an auxiliary protecting member may be provided in the zone in question at some distance below the lower edge of the skirt of the lid, e.g. at a distance such that the edge of a coin may be introduced into the intervening space. The auxiliary protecting member may e.g. be formed by constructing the main protecting member with a downwardly offset portion at the position in question, similarly as illustrated in FIGS. 1–3 of the above mentioned U.K. patent specification No. 1,489,915.

Alternatively, access to the lower edge of the skirt of the lid may be established by constructing a length of the protecting member as a tear-off portion connected with the container wall through a line of weakness, similarly as illustrated in FIGS. 4 and 5 of the above mentioned U.K. patent specification No. 1,489,915.

DESCRIPTION OF THE PREFERRED EMBODIMENT

Figure 1:
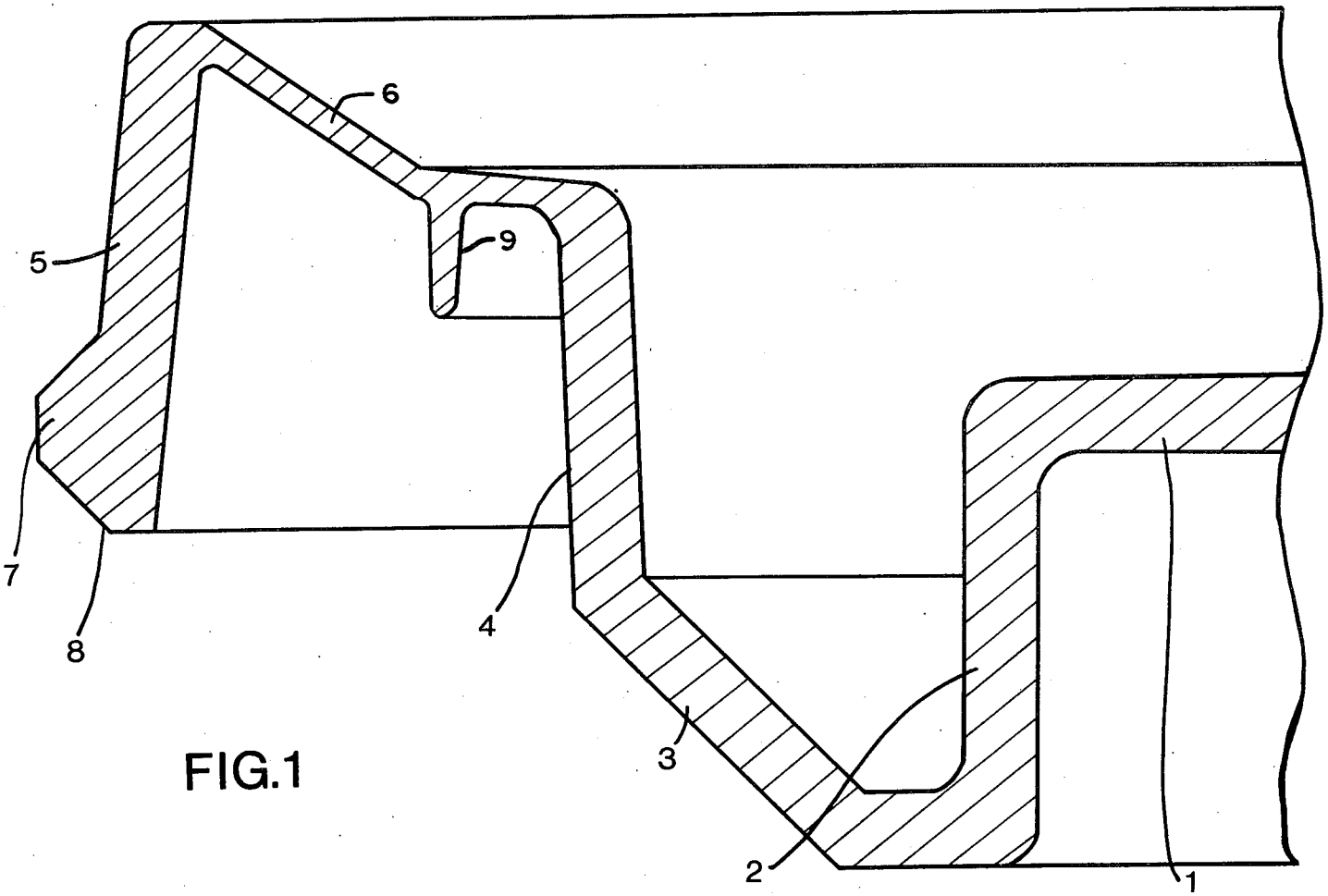
FIG. 1 shows a cross-section through the edge portion of the lid of a container according to a preferred embodiment of the invention.

The lid shown in FIG. 1 comprises a plane central area 1 which via a vertical wall 2 and an inclined wall 3 is connected with a substantially vertical outer wall 4. The outer wall 4 is connected at its upper edge via a flexible inclined wall 6 to a skirt 5.

At the lower edge of the skirt 5 there is provided an outwardly directed bead 7 having a downwardly facing inclined surface 8, and on the underside of the relatively thin inclined wall 6 there is provided an annular downwardly extending flange 9.

Figure 2:
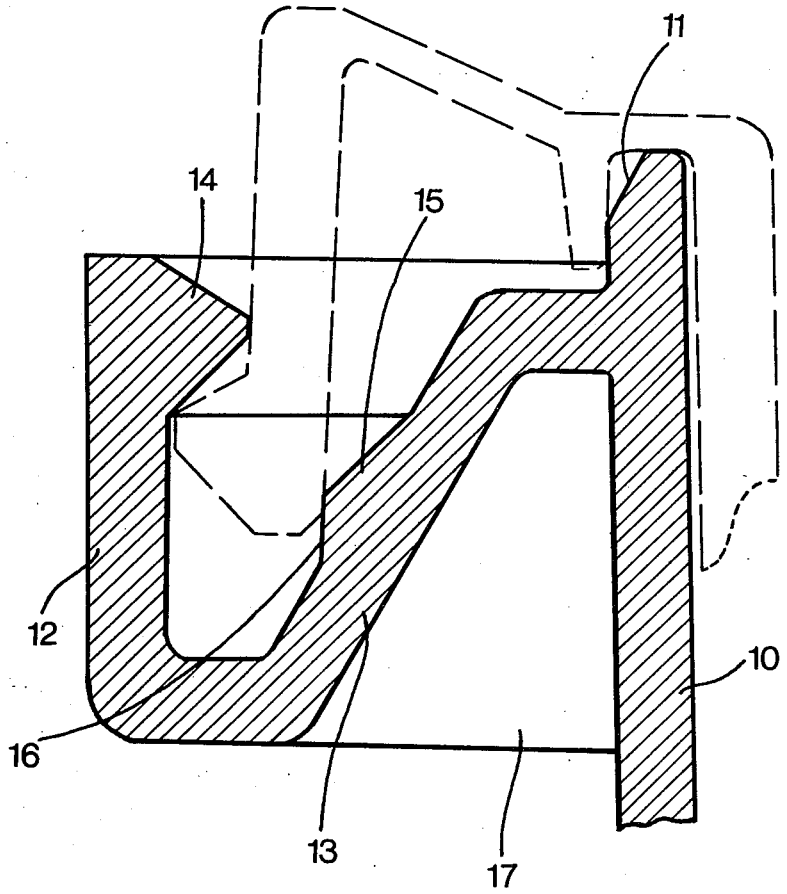
FIG. 2 shows a cross-section through the upper portion of the side wall of the container, the section being taken along the line II—II in FIG. 4.

The container shown in FIG. 2 comprises a container wall 10, the upper edge portion of which is constructed with an inclined guiding surface 11 for guiding the lid into position in the process of applying such lids by automatic means. The container also comprises a protecting member comprising a vertical protecting flange 12 and an inclined wall 13 connecting the lower edge of the flange 12 with the outer side of the container wall 10.

At the upper edge of the protecting flange 12 there is provided an inwardly extending bead 14, and at the outer side of the inclined wall 13 this is constructed with a projecting portion 15 having a vertical surface 16.

In the embodiment shown, the inclined wall 13 is connected with the outer side of the container wall 10 by means of supporting ribs 17.

FIG. 2 illustrates in dashed lines the manner of applying the lid of FIG. 1 to the container of FIG. 2.

When the lid has been applied to the container, the outer wall 4 of the lid extends parallel to and in contact with the inner side of the container wall 10, and the annular flange 9 extends along the outer side of the container wall. The zone of actual sealing is formed between the upper edge of the container wall 10 in contact with the underside of the lid.

As illustrated in FIG. 1, the skirt 5 of the lid is located, in the closed position, in the space between the protecting flange 12 and the inclined wall 13, the outwardly directed bead 7 being present under the inner bead 14 of the protecting flange 12, and the inner side of the skirt 5 of the lid being in contact at its lower end portion with the vertical surface 16 on the thickened portion 15 of the inclined wall 13.

When applying the lid to the container by pressing the lid against the container mouth, the skirt of the lid will be pressed towards the container wall 10, the inclined surface 8 of the skirt sliding along the inclined upper surface of the inner bead 7 of the protecting flange 12. During the continued downward movement of the lid, the tip of the bead 7 will move past the tip of the bead 14, and a clicking sound will be heard. Thereafter the lower inner edge of the skirt 5 of the lid will slide parallel to the inclined surface of the thickened portion 15 of the inclined wall 13 until such edge reaches the upper edge of the vertical surface 16 when another clicking sound is heard, indicating that the lid has been correctly applied.

Figure 3:
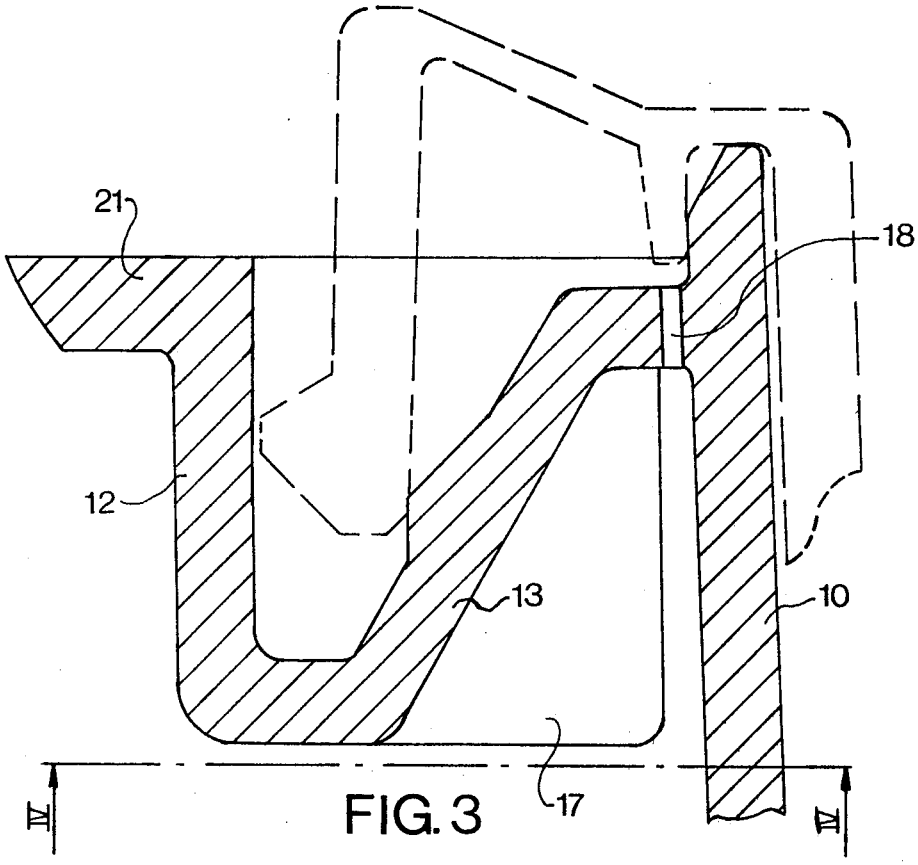
FIG. 3 shows a cross-section corresponding to that of FIG. 2, but taken along the line III—III in FIG. 4.
Figure 4:
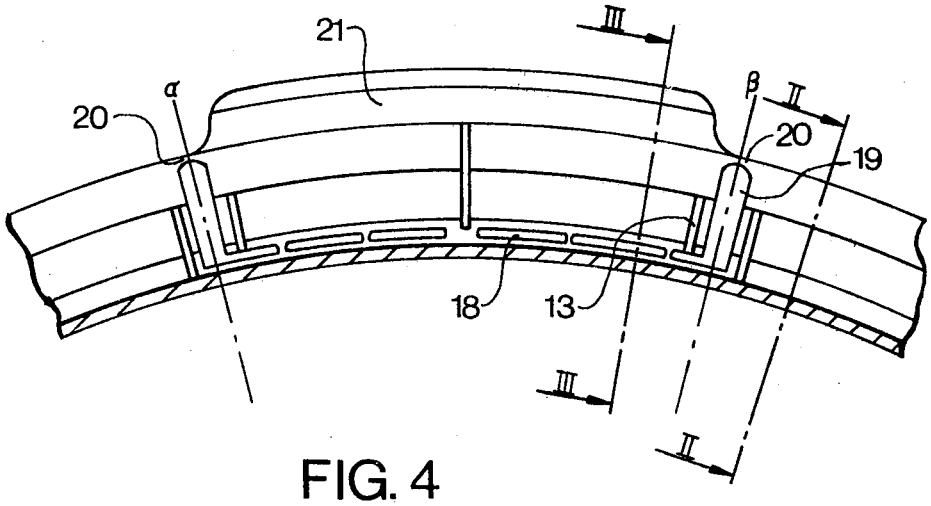
FIG. 4 shows on a reduced scale a cross-section along the line IV—IV in FIG. 3.

FIGS. 3 and 4 illustrate an embodiment where a length of the protecting member, extending between angular positions $\alpha$ and $\beta$, is constructed as a tear-off portion. To this end, the connection between the inclined wall 13 and the container wall 10 has been weakened by means of perforations 18, the ribs 17 have been shortened so as not to connect up with the container wall 10, and at the ends of the tear-off portion, gaps 19 are provided in the inclined wall 13 and the connecting portion between the latter and the flange 12, followed up by a reduction of the wall thickness of the flange 12 itself, at 20. In the tear-off portion the flange 12 is constructed with an outwardly extending lug 21. When a pressure is exerted on the latter, the tear-off portion may easily be removed, whereafter the lower edge of the skirt 5 may be gripped and pressed upwardly to initiate disengagement of the lid from the container.

Once the tear-off portion has been removed, it cannot be re-applied, so its presence on the container is a guarantee that the container has never been opened before. After removal of the tear-off portion, the container can of course be opened and closed any number of times, and the sealing effect of the lid will remain satisfactory.

We claim:

1. A container and lid assembly formed of a plastics material, said container comprising a container wall having at its upper edge an exterior annular protecting member having a flange extending substantially parallel to said container wall over substantially the full periphery of the container and forming therebetween an upwardly facing annular recess, said protecting member being connected with the exterior side of the container wall through an inclined wall sloping downwardly from the container wall toward the lower edge of the flange, said lid having a skirt depending from the outer periphery of said lid and fitting into the upwardly facing annular recess of the container, the flange of the protecting member being provided at its upper edge with an inwardly extending bead and the skirt of the lid being provided at its lower edge with an outwardly extending bead which in the closed position of the lid is located below the inner bead of the flange of the protecting member and is in locking contact with that flange.

2. An assembly as in claim 1, in which the outer side of the inclined wall includes a projecting portion having a surface substantially parallel to said container, and being so arranged that said surface is in contact with a corresponding surface on the inner side of the skirt of the lid.

3. An assembly as in claim 1, in which supporting ribs are provided which connect the outer side of the container wall with the inner side of the inclined wall.

4. An assembly as in claim 1, in which the upper edge of the skirt of the lid is connected with the portion of the lid located above the upper edge of the container wall by means of a flexible, upwardly and outwardly inclined wall.

5. An assembly as in claim 1, in which an annular flange is provided on the underside of the lid in the area between the outer side of the container wall and the skirt of the lid.

6. The assembly as in claim 1, in which the protecting member is omitted over a sufficient length of the periphery of the container mouth to permit gripping of the lower edge of the skirt of the lid to initiate disengagement of the lid from the container.

7. An assembly as in claim 1, in which a length of the protecting member is constructed as a tear-off portion to permit gripping of the lower edge of the skirt of the lid to initiate the disengagement of the lid from the container.

8. An assembly as in claim 1, in which the inner side of the skirt is in contact with the inclined wall in the closed position of the lid.

* * * * *